US008669860B1

(12) United States Patent
Tinsley, II

(10) Patent No.: US 8,669,860 B1
(45) Date of Patent: Mar. 11, 2014

(54) SYSTEM AND METHOD FOR MONITORING ACCESS, POWER LOSS, AND PRESSURE LOSS FOR ELECTRICAL, TELECOMMUNICATIONS, AND MECHANICAL EQUIPMENT

(76) Inventor: Ronnie Dean Tinsley, II, Houston, TX (US)

( * ) Notice: Subject to any disclaimer, the term of this patent is extended or adjusted under 35 U.S.C. 154(b) by 182 days.

(21) Appl. No.: 13/474,066

(22) Filed: May 17, 2012

Related U.S. Application Data

(60) Provisional application No. 61/489,973, filed on May 25, 2011.

(51) Int. Cl.
*G08B 1/08* (2006.01)

(52) U.S. Cl.
USPC ..... 340/521; 62/50.5; 62/534

(58) Field of Classification Search
USPC ..... 340/521, 219, 324; 62/534, 50.5, 54.2, 62/129; 312/62, 217; 505/896
See application file for complete search history.

(56) References Cited

U.S. PATENT DOCUMENTS

| | | | | |
|---|---|---|---|---|
| 2005/0103029 | A1* | 5/2005 | Kawahara et al. | 62/126 |
| 2009/0077984 | A1* | 3/2009 | Tidrick | 62/129 |
| 2009/0251324 | A1* | 10/2009 | Frederick | 340/626 |
| 2011/0019452 | A1* | 1/2011 | Shinomoto et al. | 363/126 |

* cited by examiner

*Primary Examiner* — Steven Lim
*Assistant Examiner* — Kaleria Knox
(74) *Attorney, Agent, or Firm* — Buskop Law Group, PC; Wendy Buskop

(57) ABSTRACT

A monitoring system and method for monitoring electrical, mechanical, and telecommunications equipment including air conditioning components of a facility is provided. The monitoring system can include door sensors, pressure sensors, and power phase loss monitors, which can be centrally connected to a transmitter for communication over a network for notifying client devices and activating alarms. The alarms can be provided when voltage drops, pressure drops, or a door has been opened.

16 Claims, 7 Drawing Sheets

SYSTEM AND METHOD FOR MONITORING ACCESS, POWER LOSS, AND PRESSURE LOSS FOR ELECTRICAL, TELECOMMUNICATIONS, AND MECHANICAL EQUIPMENT

CROSS REFERENCE TO RELATED APPLICATIONS

The present application claims priority to and the benefit of U.S. Provisional Patent Application Ser. No. 61/489,973 filed on May 25, 2011, entitled "SYSTEM AND METHOD FOR MONITORING ACCESS, POWER LOSS, AND PRESSURE LOSS FOR ELECTRICAL, TELECOMMUNICATIONS, AND MECHANICAL EQUIPMENT." This reference is hereby incorporated herein in its entirety.

FIELD

The present embodiments generally relate to a monitoring system to regulate access to, and reduce and deter theft of electrical systems, telecommunication systems, and mechanical components for remotely located facilities or facilities in high risk areas.

BACKGROUND

A need exists for a continuous monitoring system to stop thefts of electrical wiring, telecommunications wiring, air conditioning systems, mechanical systems, and associated copper wire at facilities, such as those that do not have a constant police or security presence.

A need exists for a system for monitoring access to electrical and telecommunications equipment to improve existing safety practices within the electrical and telecommunications industry.

The present embodiments meet these needs.

BRIEF DESCRIPTION OF THE DRAWINGS

The detailed description will be better understood in conjunction with the accompanying drawings as follows.

Figure 1:
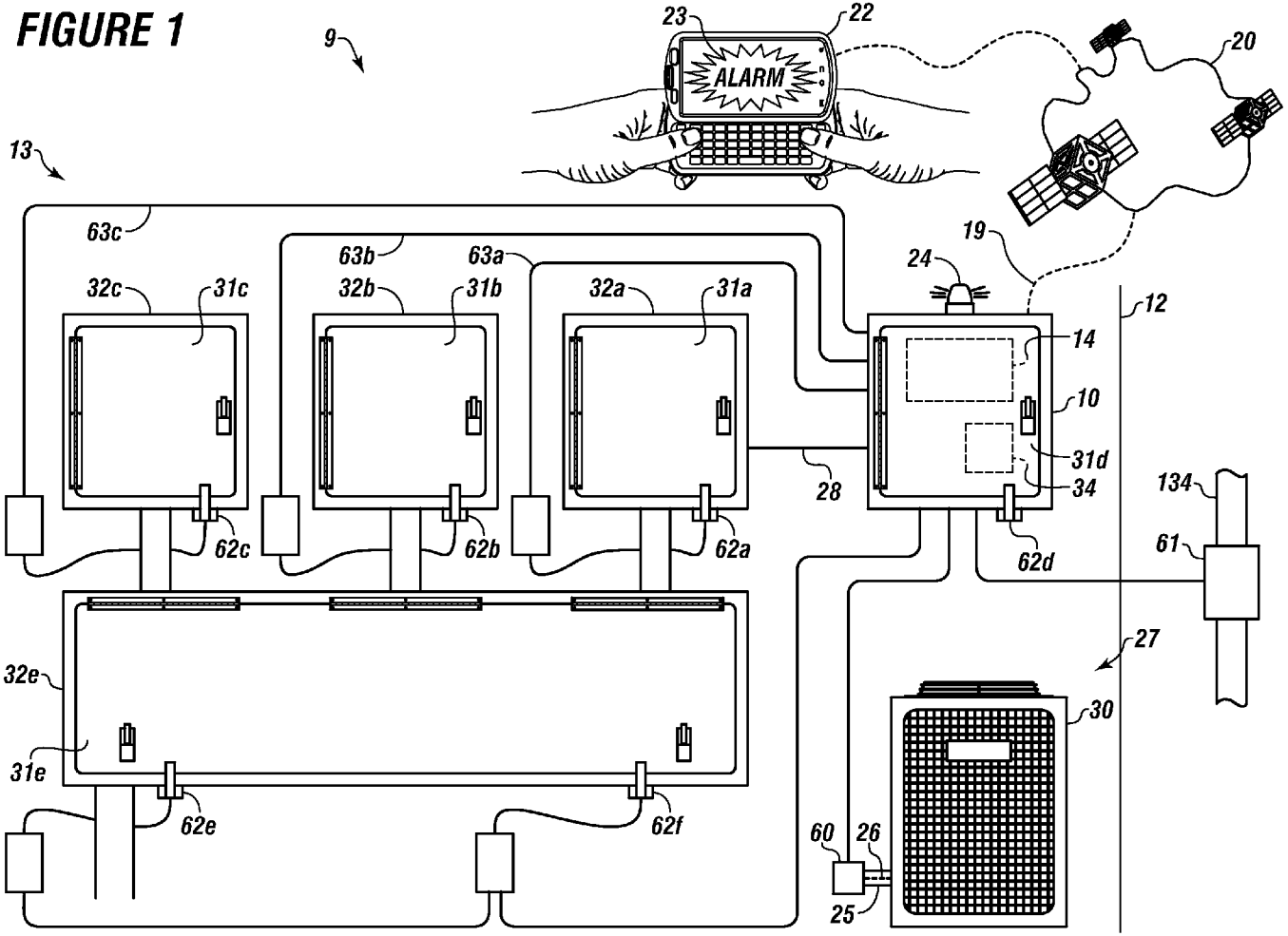
FIG. 1 depicts an overall view of the monitoring system connected to an electrical system including a connection to an onsite air conditioning unit.

The present embodiments are detailed below with reference to the listed Figures.

DETAILED DESCRIPTION OF THE EMBODIMENTS

Before explaining the present system and method in detail, it is to be understood that the system and method are not limited to the particular embodiments and they can be practiced or carried out in various ways.

The present embodiments relate to a monitoring system that can simultaneously monitor access to doors, equipment, and electrical enclosures, while also monitoring facility power supply, refrigerant line pressures, and water line pressures.

The monitoring system can prevent or reduce theft, vandalism, and other unauthorized access of electrical wiring components, telecommunication components, and mechanical components, such as air conditioning components by providing continuous, real-time monitoring The monitoring system can provide a significant theft deterrent. For example, it is common in some areas of some cities for equipment and wiring to be stolen from facilities that are vacant overnight. The stolen equipment and wiring can include electrical systems, mechanical systems, telecommunication systems, copper wiring, telecommunications wiring, aluminum wiring, fiber optic wiring, other wiring, or combinations thereof. The monitoring system can prevent or reduce such thefts, leading to lower insurance premiums for the facility.

The monitoring system can have the unique ability to simultaneously monitor all supply power lines, a status and orientation of all equipment doors, and detect refrigerant line and water line pressures.

The monitoring system can include an executive dashboard showing a status of all equipment being monitored.

The monitoring system can operate in conjunction with lock-out, tag-out safety systems on electrical panels to deter unauthorized personnel or potential thieves from cutting locks and improperly accessing the monitoring system without prior authorization.

The monitoring system can include tamper proof door sensors for sensing door orientations, a plurality of tamper proof transmitting pressure sensors for sensing refrigerant line pressure and water line pressure, and a plurality of power phase loss monitors for monitoring supply voltage.

Each sensor of the monitoring system can be connected to a transmitter for communication over a network for notifying a plurality of client devices and activating a plurality of alarms. For example, the alarms can be transmitted to the client devices when the supply voltage has been cut, a door has been opened, or pressure has dropped in a refrigerant line or a water line.

The monitoring system can immediately provide an alarm if a door is opened improperly. The alarm can sound from an unmanned alarm system, can connect via the internet or a cellular network to a police system, can connect to a facility owner via a client device, or combinations thereof. The monitoring system can thereby provide an alarm activation notice to all parties in order to stop theft, vandalism, or unauthorized access.

Client devices can be in communication with the network. The client devices can receive the alarms, samples of pressure sensor readings, supply voltage readings, other power monitoring reading, and other information from the sensors of the monitoring system.

Activation of the alarms can occur within a predetermined time period ranging from about 30 milliseconds to about 3 seconds after the occurrence of an alarm activating event.

One or more embodiments relate to a building, drilling rig, or other remote installation, such as an agricultural pump house or electrical system, having the monitoring system.

Installing the monitoring system can include identifying equipment at a facility that requires monitoring, and installing a tamper proof alarm control cabinet in an accessible area at the facility. For example, the tamper proof alarm control cabinet can be bolted to a wall of the facility.

Tamper proof door sensors can be affixed to one or more equipment doors at the facility, such as electrical equipment, telecommunications equipment, or mechanical equipment. The tamper proof door sensors can be provided with cables to provide electrical communication between the tamper proof door sensors and a circuit board in the tamper proof alarm control cabinet.

Power phase loss monitors within the tamper proof alarm control cabinet can be connected to phase conductors of a primary power supply of the facility.

Tamper proof transmitting pressure sensors can be affixed to one or more refrigerant lines and water lines of the facility. The tamper proof transmitting pressure sensors can be provided with cables to allow for electrical communication between the tamper proof transmitting pressure sensors and the circuit board in the tamper proof alarm control cabinet.

A location for a local alarm can be determined, such as a location where users will be likely to see and/or hear the local alarm. The local alarm can then be installed at the determined location, and communication between the local alarm and the circuit board in the tamper proof alarm control cabinet can be provided.

An autodialing module, such as a modem, can be installed in the tamper proof alarm control cabinet, and can be in communication with the circuit board. The autodialing module can be programmed to monitor the door orientations, the pressures, and the supply voltages. The autodialing module can be in communication with the network for transmitting remote alarms to users, such as to client devices.

In operation, the monitoring system can provide the local alarm, the remote alarm, or combinations thereof when alarm signals are received from one of the sensors of the monitoring system.

Turning now to the Figures, FIG. 1 depicts an overall view of the monitoring system 9 connected to an electrical and telecommunications system 13 and an air conditioning system 27 at a facility 12.

The monitoring system 9 can include a tamper proof alarm control cabinet 10. The tamper proof alarm control cabinet 10 can have an equipment door 31*d* with a tamper proof door sensor 62*d*.

The tamper proof alarm control cabinet 10 can be non-removably mounted to a portion of the facility 12, which can be a building, a drilling or oil rig, a trailer of a refrigerated eighteen wheeler truck, or another facility.

The tamper proof alarm control cabinet 10 can also have a circuit board 14. The tamper proof door sensor 62*d* can be in communication with the circuit board 14.

The monitoring system 9 can be in communication with various portions of the electrical and telecommunications system 13 and the air conditioning system 27 for monitoring a status of the electrical and telecommunications system 13 and the air conditioning system 27, and providing alarms.

For example, the air conditioning system 27 can have various air conditioning components, including an air conditioner compressor 30 and a refrigerant line 25 containing a refrigerant 26.

A tamper proof transmitting pressure sensor 60 can be connected to the refrigerant line 25. The tamper proof transmitting pressure sensor 60 can be a Pressure Switch-PS80-k2-F0323, made by Sensato.

The tamper proof transmitting pressure sensor 60 can be in communication with the circuit board 14. The tamper proof transmitting pressure sensor 60 can sense the pressure in the refrigerant line 25 and transmit the sensed pressure to the circuit board 14. For example, the tamper proof transmitting pressure sensor 60 can send an alarm signal to the circuit board 14 if the pressure in the refrigerant line 25 is below 25 pounds per square inch (psi) or above 65 psi.

In one or more embodiments, the monitoring system can be in communication with a plurality of refrigerant lines that each have a pressure sensor, allowing multiple refrigerant lines to be monitored simultaneously.

The monitoring system 9 can be in communication with one or more pieces of electrical or telecommunications equipment, such as equipment 32*a*, 32*b*, 32*c*, and 32*e*.

Each piece of equipment 332*a*, 32*b*, 32*c*, and 32*e* can have an equipment door, such as equipment doors 31*a*, 31*b*, 31*c*, and 31*e*.

Each equipment door 31*a*, 31*b*, and 31*c* can have a tamper proof door sensor 62*a*, 62*b*, and 62*c*. The equipment door 31*e* can have two tamper proof door sensors 62*e* and 62*f*.

For example, the equipment 32*e* can be an electrical gutter with tamper proof door sensors 62*e* and 62*f* for monitoring the status of the equipment door 31*e*.

Each tamper proof door sensor 62*a*-62*f* can sense an orientation of the associated equipment door 31*a*-31*e*, such as whether or not the equipment door 31*a*-31*e* is opened, closed, unlatched, ajar, or the like.

The tamper proof door sensors 62*a*-62*f* can be in communication with the circuit board 14 and can transmit alarm signals if the equipment doors 31*a*-31*e* are sensed to be opened, unlatched, or otherwise ajar.

Each tamper proof door sensor 62*a*-62*f* can be a magnetic door mechanism. For example, if the tamper proof door sensors 62*a*-62*f* are magnets, then an electrical circuit can be completed when the equipment doors 31*a*-31*e* are closed, latched, or not ajar. The electrical circuit can be broken when the equipment doors 31*a*-31*e* are opened, unlatched, or ajar. When the electrical circuit is completed, alarm signals can be transmitted to the circuit board 14.

For example, the equipment door 31*a* is shown transmitting an alarm signal 63*a* to the circuit board 14, the equipment door 31*b* is shown transmitting an alarm signal 63*b*, and the equipment door 31*c* is shown transmitting an alarm signal 63*c*.

Once any of the alarm signals 63*a*-63*c* are received by the circuit board 14, the circuit board 14 can provide a local alarm 24 at the facility 12, such as a strobe light, a flashing light, a siren, or another local alarm. The local alarm 24 can be a siren/strobe, model SSX-52, available from AMSECO.

The circuit board 14 can also provide a remote alarm signal 19 through a network 20, such as a cellular network, the Internet, or a satellite network. The remote alarm signal 19 can communicate through the network 20 to a client device 22, allowing the client device 22 to provide a remote alarm 23 to a remote user.

In one or more embodiments, the equipment 32*a* can be a central box for receiving incoming power from incoming power lines. A phase conductor 28 of the primary power supply of the facility 12 can supply power to the facility 12 and to the tamper proof alarm control cabinet 10.

A power phase loss monitor 34 can be within the tamper proof alarm control cabinet 10, and can monitor the supply voltage of the phase conductor 28. The power phase loss monitor 34 can be in communication with the circuit board 14 and the phase conductor 28.

The power phase loss monitor 34 can monitor the supply voltage, and if the supply voltage drops, the power phase loss monitor 34 can transmit an alarm signal to the circuit board 14. For example, if someone attempts to cut off supply voltage to the facility 12 during a robbery, the power phase loss monitor 34 can send the alarm signal to the circuit board 14 to initiate the local alarm 24, the remote alarm 23, or combinations thereof.

The circuit board 14 can be in communication with a water line tamper proof transmitting pressure sensor 61. The water line tamper proof transmitting pressure sensor 61 can be on a water line 134 for monitoring the pressure therein. The water line tamper proof transmitting pressure sensor 61 can transmit an alarm signal if the pressure in the water line 134 rises above or falls below a preset limit.

Figure 2:
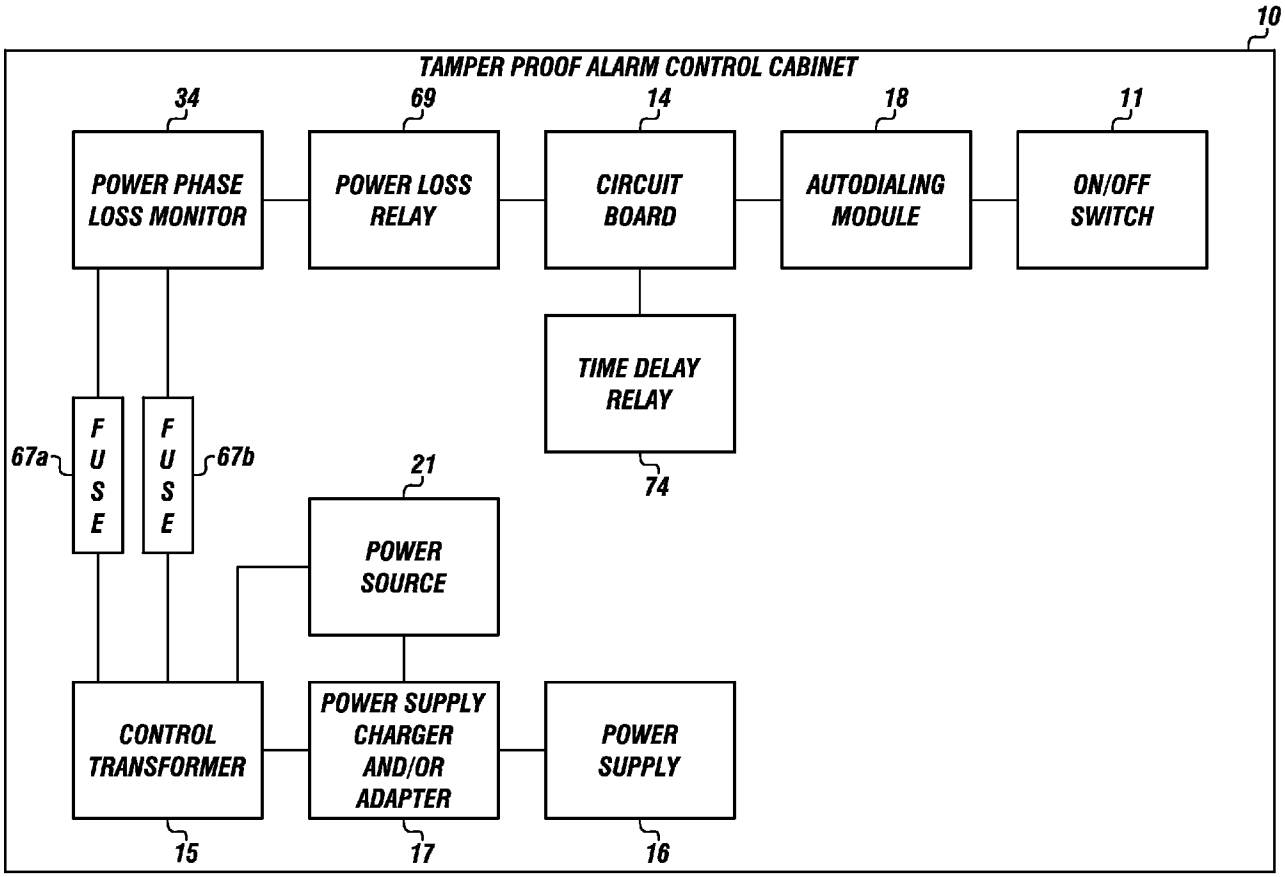
FIG. 2 depicts a diagram of an interior of a tamper proof alarm control cabinet.

FIG. 2 depicts a diagram of the interior of the tamper proof alarm control cabinet 10 of the monitoring system. In one or more embodiments, the tamper proof alarm control cabinet 10 can be a stainless steel hinged enclosure with dimensions of eighteen inches by eighteen inches by six inches.

The tamper proof alarm control cabinet 10 can have the circuit board 14 disposed therein. The circuit board 14 can be a series of relays. For example, the circuit board 14 can include an ELK-912 12 vdc relay available from ELK Products, a single phase loss relay—ICM 491 available from ICM Controls, a three phase loss relay—ICM 402 available from ICM Controls, or combinations thereof.

The circuit board 14 can be in electrical communication with an autodialing module 18, which can be in electrical communication with an on/off switch 11, which can be used to turn the monitoring system on and off. The autodialing module 18 can be a GSM/GPRS Module, model RP200GSXMUSA, available from RISCO Group. The autodialing module 18 can be in communication with the network for initiating remote alarms.

The circuit board 14 can also be in electrical communication with a time delay relay 74, which can be in communication with the local alarm. The time delay relay 74 can be an ELK-960 12 vdc delay timer relay, available from ELK Products. The time delay relay 74 can initiate the local alarm when the circuit board 14 receives alarm signals.

The tamper proof alarm control cabinet 10 can include a power supply 16, which can be a 12 volt DC battery, an independent uninterruptible power supply for providing continuous use of the monitoring system for at least eight hours after a power failure, or combinations thereof. For example, the power supply 16 can be a model UB1280, available from Universal Battery.

The power supply 16 can be in electrical communication with a power supply charger and/or adapter 17, which can be a 120 volt AC-DC charger, such as a model D1761, available from Universal Power Group.

The power supply charger and/or adapter 17 can receive power from a power source 21, such as a wall outlet or another power source, and can charge the power supply 16.

For example, the power source 21 can be an AC plug. The power source 21 and the power supply charger and/or adaptor 17 can be in electrical communication with a control transformer 15.

The control transformer 15 can have a fused connection via fuses 67*a* and 67*b* to a power phase loss monitor 34.

The power phase loss monitor 34 can be in electrical communication with a power loss relay 69. The power loss relay 69 can be in electrical communication with the circuit board 14. The power loss relay 69 can be an 8 pin Ice Cube Relay, model LY2, or a base Ice Cube Relay, model 1810H1, both available from Omron.

Figure 3:
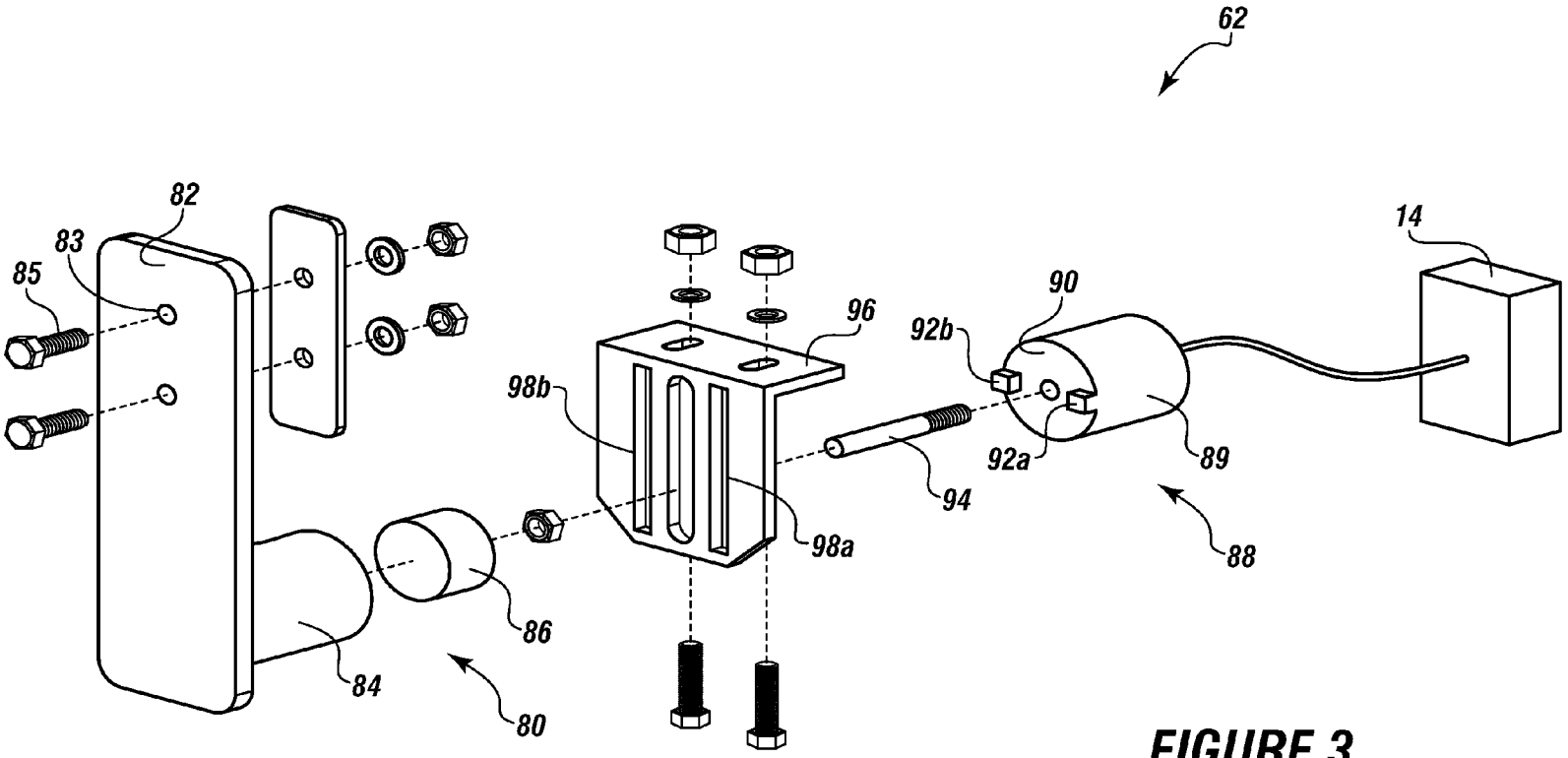
FIG. 3 depicts an exploded perspective view of a tamper proof door sensor of the monitoring system.

FIG. 3 depicts an exploded perspective view of a tamper proof door sensor 62 of the monitoring system. One or more embodiments of the tamper proof door sensor 62 can have a gasket, such as a neoprene rubber gasket for use of the tamper proof door sensor 62 outdoors.

The tamper proof door sensor 62 can have a magnet portion 80 for mounting to one side of a movable equipment or access panel door, such as the equipment doors depicted in FIG. 1.

The magnet portion 80 can have an elongated body 82 with at least one mounting hole 83 formed for receiving at least one mounting screw 85, such as a ¼ inch bolt configured to engage a ¼ inch nut and lock washer.

The elongated body 82 can have a magnet housing 84 on one side. A magnet 86 can be disposed inside the magnet housing 84.

The tamper proof door sensor 62 can have a shield portion 88 and a reed switch mounting bracket 96.

The shield portion 88 can have a shield housing 89. A reed switch 94 can be centrally disposed in the shield housing 89. The reed switch 94 can be a threaded reed magnetic switch, such as a model P131-A4-915, available from Soway Industries.

The reed switch 94 can be connected to and in electrical communication with the circuit board 14, such as through wires or a wireless connection.

The shield housing 89 can have a shield front face 90 with a pair of prongs 92*a* and 92*b*. The pair of prongs 92*a* and 92*b* can extend from the shield front face 90 to engage through openings 98*a* and 98*b* in the reed switch mounting bracket 96, thereby providing a tamperproof connection.

The reed switch mounting bracket 96 can be mounted to a non-moving portion of the electrical equipment, telecommunications equipment, mechanical equipment, or combinations thereof.

The reed switch 94 can engage through the reed switch mounting bracket 96 and into the magnetic housing 84.

The shield housing 89 can provide protection against an unauthorized person placing another magnet next to the reed switch 94 to defeat the normal operational properties of the reed switch 94.

The reed switch 94 can provide an alarm signal to the circuit board 14 when the reed switch 94 is separated from the magnet 86.

The magnet 86 can be centrally contained within the magnet housing 84, such that only a face of the magnet 86 can be engaged with other portions of the tamper proof door sensor 62.

The tamper proof door sensor 62 can function to sense door orientation to determine if the door is opened, unlatched, or otherwise ajar. For example, if the door is opened, unlatched, or otherwise ajar, an alarm signal can be transmitted to the circuit board 14.

The alarm signal can be a signal to cause an enforcement authority to arrive at the facility, a signal that initiates a visual light alarm, an email message, a text message, a voice message, a signal to actuate a local audible alarm, a signal to actuate another local security system, or combinations thereof.

Figure 4:
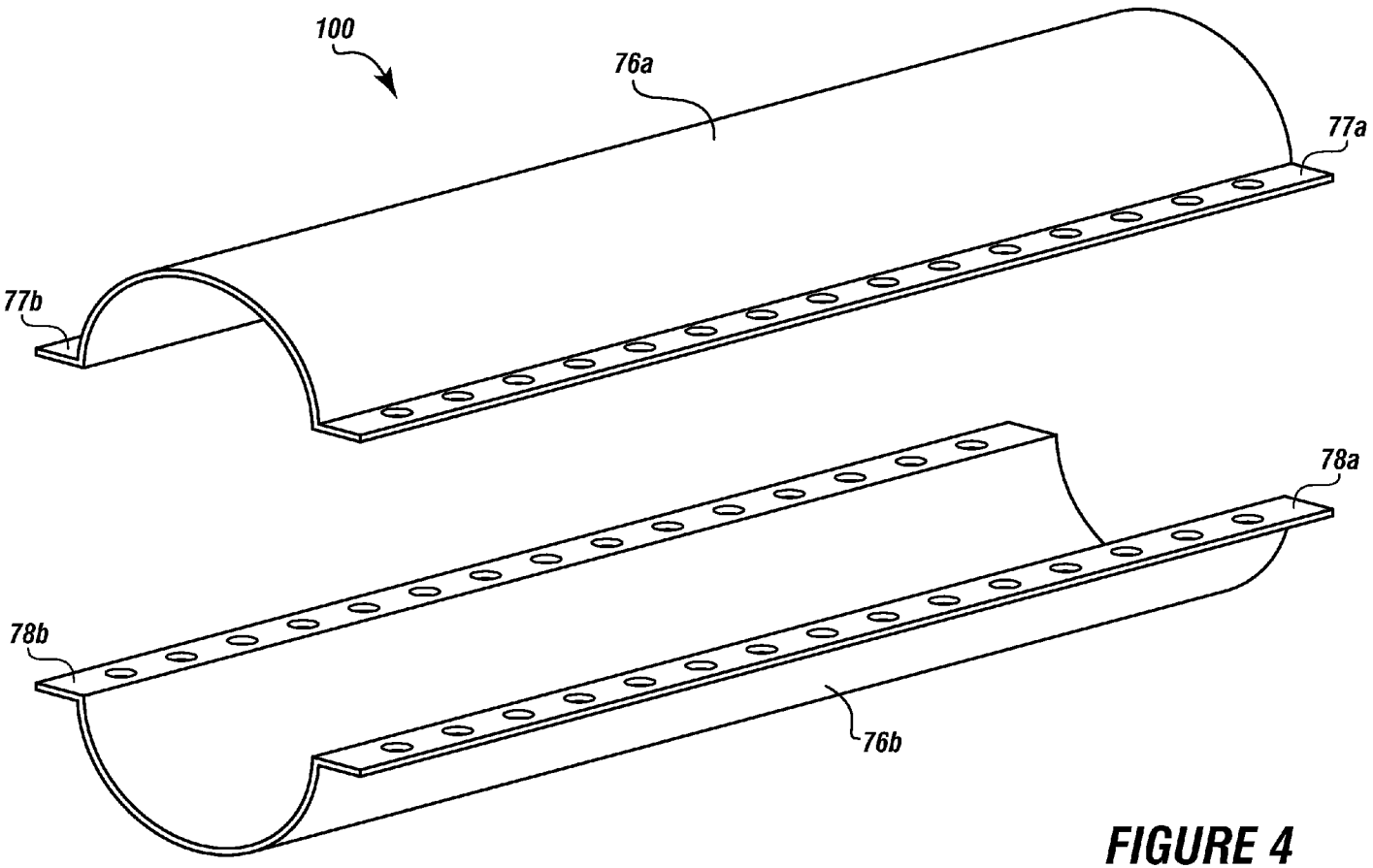
FIG. 4 depicts an exploded perspective view of a two-part flanged locking pipe guard.

FIG. 4 depicts an embodiment of a two-part flanged locking pipe guard 100 for placement around wires or conduits containing wires. The two-part flanged locking pipe guard 100 can prevent thieves from easily cutting supply voltage, such as by using sledgehammers, cutting tools, or the like.

The two-part flanged locking pipe guard 100 can include a first conduit half 76*a*, a second conduit half 76*b*, first flanges 77*a* and 77*b*, and second flanges 78*a* and 78*b*.

The first conduit half 76*a* can be connected over the second conduit half 76*b*, and wires or the like can be contained between the first conduit half 76*a* and the second conduit half 76*b*.

The first flanges 77*a* and 77*b* can engage over the second flanges 78*a* and 78*b*. Each flange can have flange holes which can receive fasteners for fastening the first flanges 77*a* and 77*b* to the second flanges 78*a* and 78*b*.

In one or more embodiments, the first conduit half 76*a* and the second conduit half 76*b* can each have an inner diameter of 2.375 inches, 2.875 inches, 3.5 inches, or 4.5 inches, to accommodate different sizes of wires and conduits.

In one or more embodiments, a distance from a center of one flange hole to a center of another flange hole can be about 4 inches. The first flanges 77*a* and 77*b* and the second flanges 78*a* and 78*b* can be about 1.25 inches wide.

Figure 5:
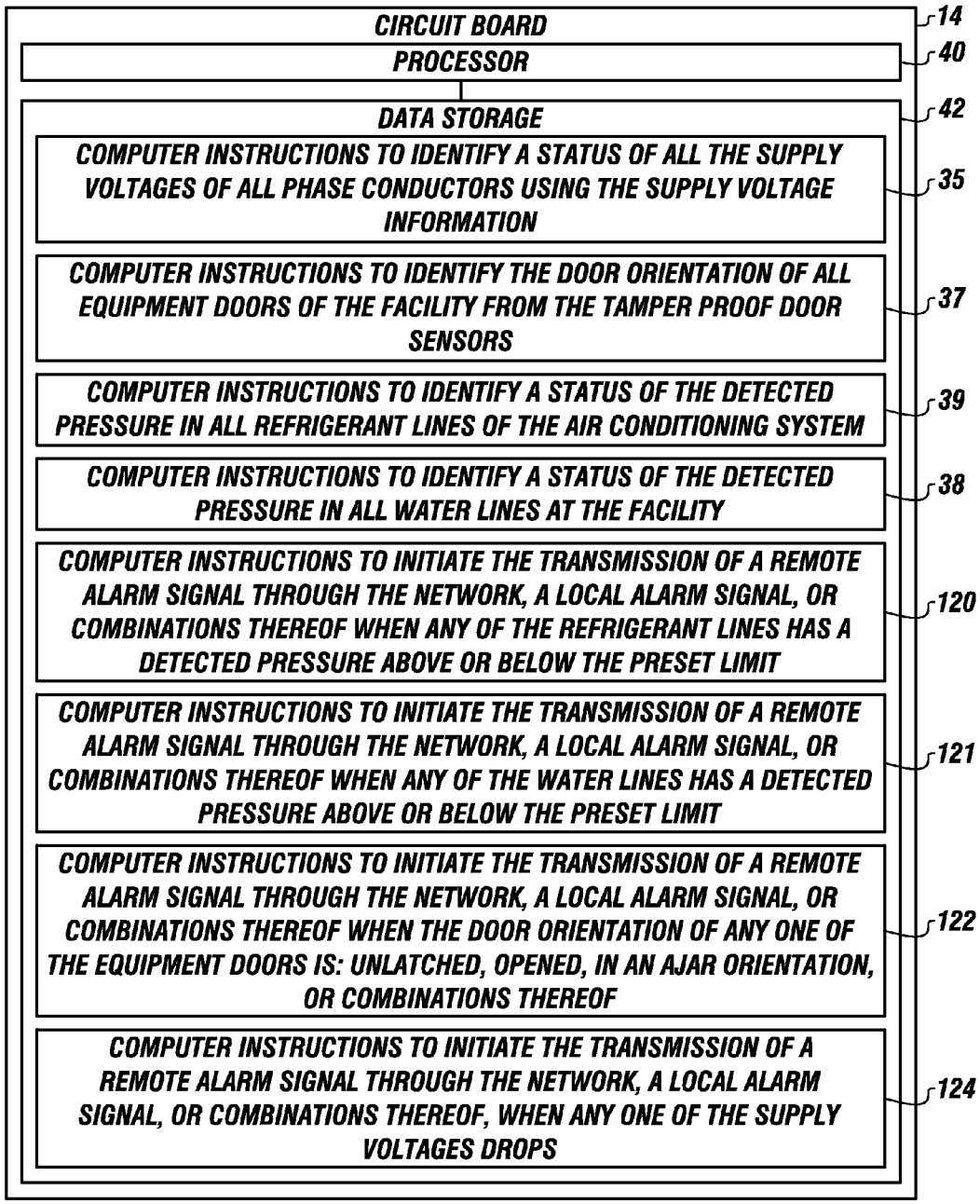
FIG. 5 depicts a diagram of a circuit board according to one or more embodiments.

FIG. 5 depicts a diagram of computer instructions in the circuit board 14 having a processor 40 and a data storage 42 with computer instructions stored therein.

The data storage 42 can have computer instructions to identify a status of all the supply voltages of all phase conductors using the supply voltage information 35.

For example, the processor 40 can identify a status of a phase loss monitor when the phase loss monitor transmits alarm signals to the circuit board 14.

The data storage 42 can have computer instructions to identify the door orientation of all equipment doors of the facility from the tamper proof door sensors 37.

For example, the processor 40 can identify the door orientation of an equipment door when the equipment door transmits an alarm signal to the circuit board 14.

The data storage 42 can have computer instructions to identify a status of the detected pressure in all refrigerant lines of the air conditioning system 39.

For example, the processor 40 can identify a status of a detected pressure in a refrigerant line when the refrigerant line transmits an alarm signal to the circuit board 14.

The data storage 42 can have computer instructions to identify a status of the detected pressure in all water lines at the facility 38.

For example, the processor 40 can identify a status of a detected pressure in a water line when the water line transmits an alarm signal to the circuit board 14.

The circuit board 14 can transmit the alarms to the network, at least one client device, the local alarm, or combinations thereof when any one of the supply voltage status drops below a preset limit or rises above a preset limit; any one of the door orientations is ajar, unlatched, opened, or combinations thereof; or any one of the refrigerant lines or water lines has a pressure that drops below a preset limit or rises above a preset limit.

For example, the data storage 42 can have computer instructions to initiate the transmission of a remote alarm signal through the network, a local alarm signal, or combinations thereof when any of the refrigerant lines has a detected pressure below the preset limit 120.

The data storage 42 can have computer instructions to initiate the transmission of a remote alarm signal through the network, a local alarm signal, or combinations thereof when any of the water lines has a detected pressure below the preset limit 121.

The data storage 42 can have computer instructions to initiate the transmission of a remote alarm signal through the network, a local alarm signal, or combinations thereof when the door orientation of any one of the equipment doors is: unlatched, opened, in an ajar orientation, or combinations thereof 122.

The data storage 42 can have computer instructions to initiate the transmission of a remote alarm signal through the network, a local alarm signal, or combinations thereof, when any one of the supply voltages drops 124.

Figure 6:
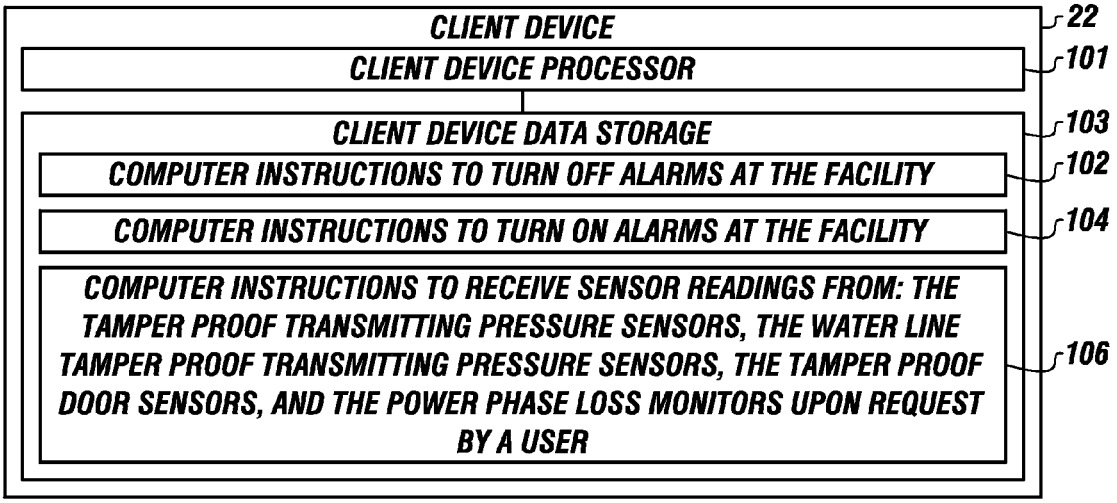
FIG. 6 depicts a diagram of a client device according to one or more embodiments.

FIG. 6 depicts a client device 22 having a client device processor 101 and a client device data storage 103.

The client device data storage 103 can have computer instructions to turn off alarms at the facility 102, and computer instructions to turn on alarms at the facility 104.

The client device data storage 103 can also have computer instructions to receive sensor readings from: the tamper proof transmitting pressure sensors, the water line tamper proof transmitting pressure sensors, the tamper proof door sensors, and the power phase loss monitors upon request by a user 106.

For example, the client device 22 can receive text messages providing the sensor readings.

Figure 7:
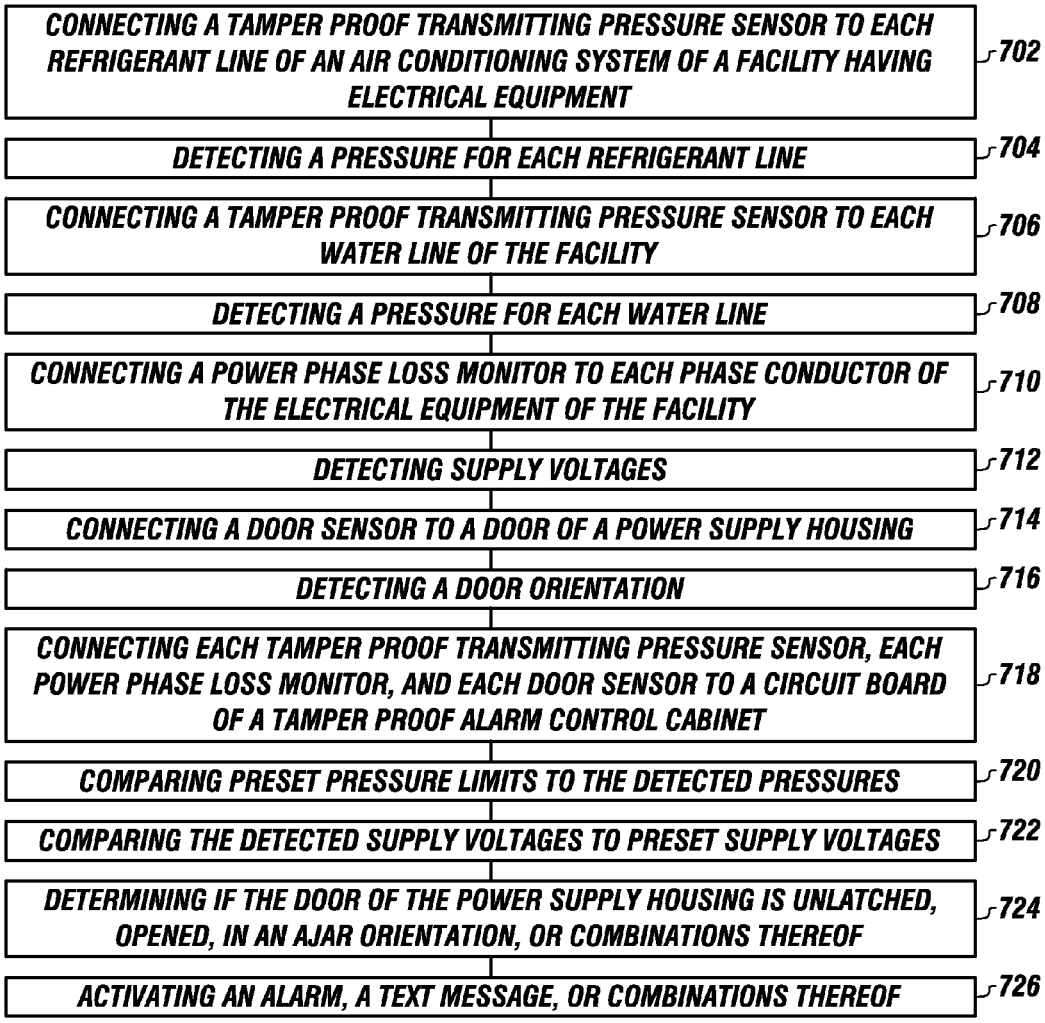
FIG. 7 depicts a method for monitoring electrical, telecommunications, and mechanical equipment according to one or more embodiments.

FIG. 7 depicts an embodiment of a method for determining unauthorized access, theft, or combinations thereof, of electrical equipment, telecommunication equipment, or mechanical equipment.

The method can include connecting a tamper proof transmitting pressure sensor to each refrigerant line of an air conditioning system of a facility having electrical equipment, as illustrated by box 702.

The method can include detecting a pressure for each refrigerant line, as illustrated by box 704.

The method can include connecting a tamper proof transmitting pressure sensor to each water line of the facility, as illustrated by box 706.

The method can include detecting a pressure for each water line, as illustrated by box 708.

The method can include connecting a power phase loss monitor to each phase conductor of the electrical equipment of the facility, as illustrated by box 710.

The method can include detecting supply voltages, as illustrated by box 712.

The method can include connecting a door sensor to a door of a power supply housing, as illustrated by box 714.

In one or more embodiments, tamper proof door sensors can be connected to each equipment door of the electrical equipment, telecommunications equipment, and the power supply housing at the facility.

The method can include detecting a door orientation, as illustrated by box 716.

The method can include connecting each tamper proof transmitting pressure sensor, each power phase loss monitor, and each door sensor to a circuit board of a tamper proof alarm control cabinet, as illustrated by box 718.

The method can include comparing preset pressure limits to the detected pressures, as illustrated by box 720.

The method can include comparing the detected supply voltages to preset supply voltages, as illustrated by box 722.

The method can include determining if the door of the power supply housing is unlatched, opened, in an ajar orientation, or combinations thereof, as illustrated by box 724.

The method can include activating an alarm, a text message, or combinations thereof, as illustrated by box 726.

For example, the alarm can be activated when: any detected pressure is outside of the preset pressure limits; any supply voltage is outside of the preset supply voltage limits; and any equipment door is: unlatched, opened, in an ajar orientation, or combinations thereof.

While these embodiments have been described with emphasis on the embodiments, it should be understood that within the scope of the appended claims, the embodiments might be practiced other than as specifically described herein.

What is claimed is:

1. A monitoring system for components of an electrical system, telecommunications system, mechanical system, or air conditioning system for a facility, the monitoring system comprising:

a. a tamper proof transmitting pressure sensor secured to each refrigerant line of the air conditioning system, wherein each tamper proof transmitting pressure sensor is configured to detect pressure in each refrigerant line, and wherein each tamper proof transmitting pressure sensor is configured to provide alarm signals to a circuit board of the monitoring system;

b. a tamper proof door sensor secured to at least one equipment door at the facility, wherein each tamper proof door sensor is configured to detect door orientations of the at least one equipment door to determine if the at least one equipment door is: opened, unlatched, in an ajar orientation, or combinations thereof, and wherein each tamper proof door sensor is configured to provide alarm signals to the circuit board;

c. a power phase loss monitor connected to each phase conductor of a primary power supply of the facility, wherein each power phase loss monitor is configured to detect the supply voltage of each phase conductor and transmit supply voltage information and alarm signals to the circuit board; and d. a tamper proof alarm control cabinet attached to the facility, wherein the tamper proof alarm control cabinet comprises:

(i) an on/off switch;

(ii) a control transformer configured to accept power from a power source to power the monitoring system;

(iii) an independent uninterruptible power supply in communication with the circuit board for providing continuous use of the monitoring system;

(iv) a power supply charger and/or adapter configured to accept power from the power source and to charge the independent uninterruptible power supply;

(v) an autodialing module in communication with a network, wherein the autodialing module is configured to transmit a remote alarm signal to a remote alarm, a local alarm signal to a local alarm, or combinations thereof, when:

1. the detected pressure in one of the refrigerant lines drops below or rises above a preset pressure limit;
2. the door orientation of one of the at least one equipment doors is: opened, unlatched, in an ajar orientation, or combinations thereof;
3. the supply voltage of one of the phase conductors of the primary power supply of the facility drops below a preset supply voltage limit; or
4. combinations thereof; and (vi) the circuit board, wherein the circuit board comprises:

1. computer instructions to identify a status of the detected pressure in each refrigerant line;
2. computer instructions to identify the door orientation of each equipment door of the facility from the tamper proof door sensors; and
3. computer instructions to identify a status of the supply voltages of each phase conductor of the primary power supply of the facility using the supply voltage information.

2. The monitoring system of claim 1, wherein the electrical system, the telecommunications system, the mechanical system, and the air conditioning system comprise: copper wiring, telecommunication equipment, aluminum wiring, fiber optic wiring, other wiring, or combinations thereof.

3. The monitoring system of claim 1, further comprising: at least one time delay relay connected between the remote alarm and the autodialing module in the tamper proof alarm control cabinet, at least one relay connected between the local alarm and the autodialing module in the tamper proof alarm control cabinet, or combinations thereof.

4. The monitoring system of claim 1, further comprising an additional tamper proof door sensor on a door of the tamper proof alarm control cabinet, wherein the additional tamper proof door sensor is in communication with the circuit board for providing an alarm signal when the door of the tamper proof alarm control cabinet is: opened, unlatched, in an ajar orientation, or combinations thereof.

5. The monitoring system of claim 1, wherein each tamper proof door sensor comprises:

a. a magnet portion mounted to at least one the equipment door, wherein the magnet portion has an elongated body, a magnet housing mounted to the elongated body, and a magnet within the magnet housing;

b. a shield portion comprising: a shield housing, a shield front face, and a pair of prongs extending from the shield front face to provide tamperproof protection;

c. a reed switch centrally disposed in the shield housing for engagement with the magnet, wherein the reed switch provides an alarm signal to the circuit board when the reed switch is separated from the magnet; and d. a reed switch mounting bracket connected to the shield portion comprising at least two openings, wherein each opening is configured to accept one of the pair of prongs, and wherein the reed switch mounting bracket is mounted to a non-moving portion of electrical equipment, telecommunications equipment, or combinations thereof associated with the equipment door.

6. The monitoring system of claim 1, further comprising a client device in communication with the network, wherein the autodialing module transmits to the client device: the detected pressures, the supply voltages, the door orientations, or combinations thereof.

7. The monitoring system of claim 6, wherein the client device receives the detected pressures, the supply voltages, the door orientations, or combinations thereof as a text message, an email, a verbal message, or an audible message.

8. The monitoring system of claim 6, wherein the client device is in communication with the circuit board and is configured to turn the remote alarm and the local alarm on and off.

9. The monitoring system of claim 6, wherein the client device receives the detected pressures, the supply voltages, the door orientations, or combinations thereof at predetermined intervals.

10. The monitoring system of claim 1, further comprising a two-part flanged locking pipe guard configured to be disposed around wire and wire conduits to protect the wire and wire conduits at the facility.

11. The monitoring system of claim 1, wherein activation of the remote alarm signals and the local alarm signals occurs in a predetermined time period ranging from thirty milliseconds to three seconds.

12. The monitoring system of claim 1, further comprising computer instructions in the circuit board to:

a. initiate the transmission of the remote alarm signal, the local alarm signal, or combinations thereof when any of the refrigerant lines has a detected pressure above or below the preset pressure limit;

b. initiate the transmission of the remote alarm signal, the local alarm signal, or combinations thereof when the door orientation of the at least one equipment doors is: opened, unlatched, in an ajar orientation, or combinations thereof; and c. initiate the transmission of the remote alarm signal, the local alarm signal, or combinations thereof when the supply voltage of any of the phase conductors drops, wherein the remote alarm signal and the local alarm signal are: signals configured to cause an enforcement authority to arrive at the facility, visual light alarms, email messages, text messages, voice messages, audible alarms, signals to actuate a local security system, or combinations thereof.

13. The monitoring system of claim 1, wherein the facility is a building, a drilling rig, an oil rig, a trailer on truck, a remote installation, or an agricultural pump house.

14. The monitoring system of claim 1, further comprising: an additional tamper proof door sensor on an electrical gutter of the facility, wherein:

a. the additional taper proof door sensor is in communication with the circuit board;

b. the additional tamper proof door sensor is configured to sense if a door of the electrical gutter is opened, unlatched, ajar, or combinations thereof; and c. the circuit board is configured to initiate the remote alarm, the local alarm, or combinations thereof if the door of the electrical gutter is sensed to be opened, unlatched, ajar, or combinations thereof.

15. The monitoring system of claim 1, further comprising: a water line tamper proof transmitting pressure sensor on a water line of the facility, wherein:

a. the water line tamper proof transmitting pressure sensor is in communication with the circuit board;

b. the water line tamper proof transmitting pressure sensor is configured to sense water pressure in the water line; and c. the circuit board is configured to initiate the remote alarm, the local alarm, or combinations thereof if the water pressure in the water line drops below a preset water pressure limit.

16. A method for determining unauthorized access, theft, or combinations thereof, of electrical equipment, telecommunication equipment, mechanical equipment, and air conditioning systems, the method comprising:

a. connecting a tamper proof transmitting pressure sensor to each refrigerant line of an air conditioning system of a facility, and detecting a pressure for each refrigerant line;

b. connecting a tamper proof transmitting pressure sensor to each water line of the facility, and detecting a pressure for each water line;

c. connecting a power phase loss monitor to each phase conductor of a primary power supply of the facility and detecting supply voltages of the phase conductors;

d. connecting tamper proof door sensors to equipment doors of electrical equipment, telecommunications equipment, mechanical equipment, a power supply housing, or combinations thereof, and detecting a door orientation of each equipment door;

e. connecting each tamper proof transmitting pressure sensor, each power phase loss monitor, and each tamper proof door sensor to a circuit board of a tamper proof alarm control cabinet;

f. comparing preset pressure limits to the detected pressures, comparing the detected supply voltages to preset supply voltage limits, and determining door orientation for each equipment door, wherein the door orientations comprise: opened, unlatched, ajar, or combinations thereof; and g. activating an alarm, a text message, or combinations thereof, when:

(i) any detected pressure is outside of the preset pressure limits;

(ii) any supply voltage is outside of the preset supply voltage limit; and (iii) any equipment door is: unlatched, opened, in an ajar orientation, or combinations thereof.

* * * * *